US005813720A

United States Patent [19]

Huang

[11] Patent Number: 5,813,720

[45] Date of Patent: Sep. 29, 1998

[54] BABY WALKER

[75] Inventor: Li-Chu Chen Huang, Chiayi, Taiwan

[73] Assignee: Discovery International Co., Ltd., Tortola, United Kingdom

[21] Appl. No.: 986,033

[22] Filed: Dec. 5, 1997

[51] Int. Cl.[6] ..... B62B 9/12

[52] U.S. Cl. ..... 297/5; 280/87.051; 482/68

[58] Field of Search ..... 297/5, 440.22; 482/68; 280/87.05, 87.051

[56] References Cited

U.S. PATENT DOCUMENTS 5,054,851 10/1991 Chiu ..... 297/5 X 5,056,776 10/1991 Cheng ..... 482/68

5,662,344 9/1997 Lu ..... 297/5 X

*Primary Examiner*—Peter R. Brown

*Attorney, Agent, or Firm*—Bacon & Thomas

[57] ABSTRACT

A baby walker includes an upper part, a lower part having wheels disposed thereto and two pairs of crosswise connected links connected between the upper part and the lower part, a seat member having a back member received therein and securely connected to the upper part. The upper member has two apertures defined diametrically opposite to each other and two first hooks formed to an underside of a periphery defining each of the apertures. The back member has two second hooks extending therefrom so as to be engaged with the first hooks.

3 Claims, 6 Drawing Sheets

BABY WALKER

BACKGROUND OF THE INVENTION

1. Field of the Invention

The present invention relates to a baby walker and, more particularly, to a baby walker having a back member securely connected thereto so as to provide a better support for a baby in the baby walker.

2. Brief Description of the Prior Art

Referring to FIGS. 1 and 2, conventional baby walkers include an upper part 90 and a lower part 900 which has wheels 901 disposed to an underside thereof and an adjustable device 902 comprising two pairs of crosswise linked rods which are connected between the upper part 90 and the lower part 900. Each of the upper and the lower part 90, 900 is a substantially ring-shaped member and a seat member 80 is disposed to a center of the upper member 90 so that a baby may be supported by the seat member 80 with his/her feet in contact with the ground. In order to provide a support of the neck and head of the baby in case of falling rearwardly, a back member 82 is connected to a rear top edge of the seat member 80. Generally, the seat member 80 is made of a fabric 81 and has an extending portion 83 to securely connect to a bolt 921 of the upper part 90. A plurality of bolts 85 extend downwardly from a rear periphery of the seat member 80 so as to be inserted into holes 93 defined through the upper part 90 and engaged with nuts 86 so as to be positioned to the upper part 90. The back member 82 includes a board 821 made of foam material and enclosed by a coating which is sewed integrally with the seat member 80. It is experienced that the back member 82 cannot provide a firm and satisfactory supporting function because an engagement between the seat member 80, the back member 82 and the upper part 90 is not strong enough.

The present invention intends to provide an improved baby walker having a firm engagement to connect the seat member and the back member to an upper part thereof so as to mitigate and/or obviate the above-mentioned problems.

SUMMARY OF THE INVENTION

The present invention provides a baby walker which comprises an upper part having an opening defined therethrough and lower part being a ring member which has a plurality of wheels rotatably disposed to an underside thereof. Two pairs of crosswise connected links are adjustably connected between the upper and lower members. A groove is defined in an upper surface thereof so as to form a collar member which defines the opening. The collar member has an arc portion having a raised upper surface so as to define two apertures between an upper surface of the collar member and the raised upper surface of the arc portion. The raised upper surface has two first hooks respectively formed to an underside of two distal ends thereof which respectively define the two apertures.

A back member has two second hooks extending from two lower ends thereof so as to be inserted through the two apertures and engaged with the two first hooks.

A seat member has two holes defined in a lower portion thereof and an envelope portion extending upwardly therefrom which has a lower periphery so as to securely connect to the collar member. The back member is received in the envelope portion.

It is an object of the present invention to provide a baby walker having a back member which is firmly connected to the baby walker.

It is another object of the present invention to provide a baby walker which provide a good support to the neck and the head of a baby seated therein.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
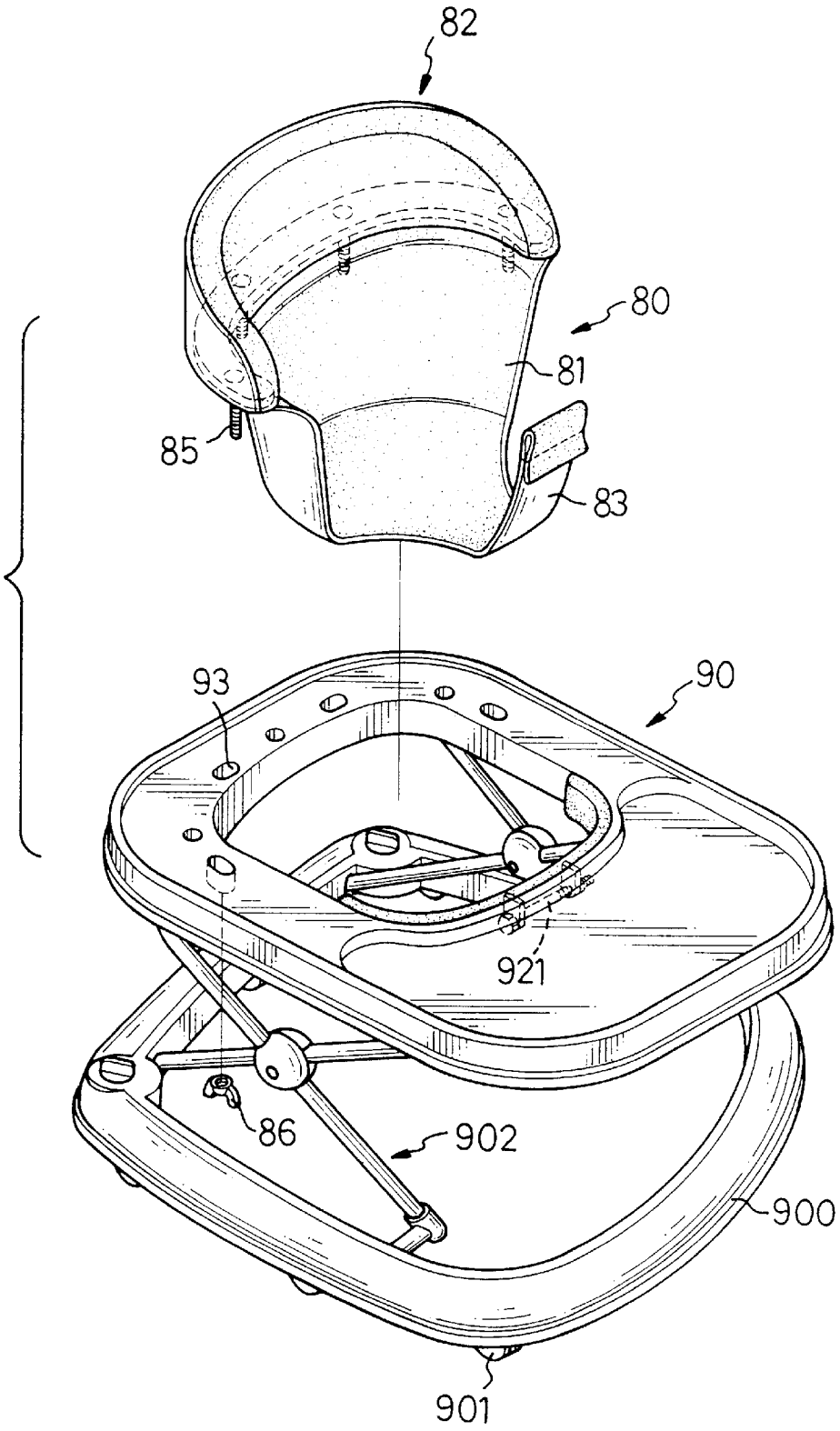
FIG. 1 PRIOR ART
FIG. 1 is an exploded view of a conventional baby walker.
Figure 2:
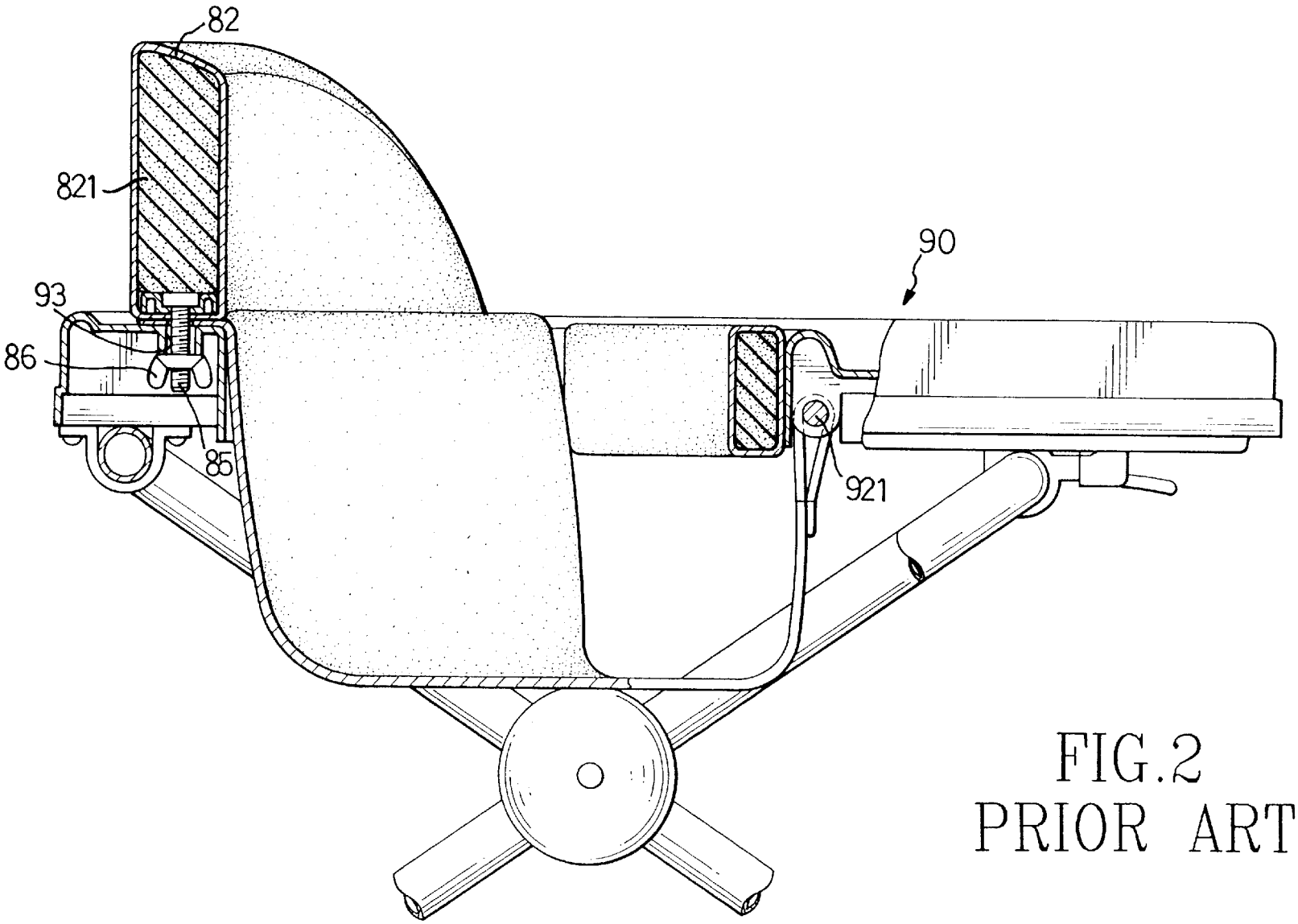
FIG.2 PRIOR ART
FIG. 2 is a side elevational view, partly in section, of a seat member and a back member disposed to an upper part of the conventional baby walker.
Figure 3:
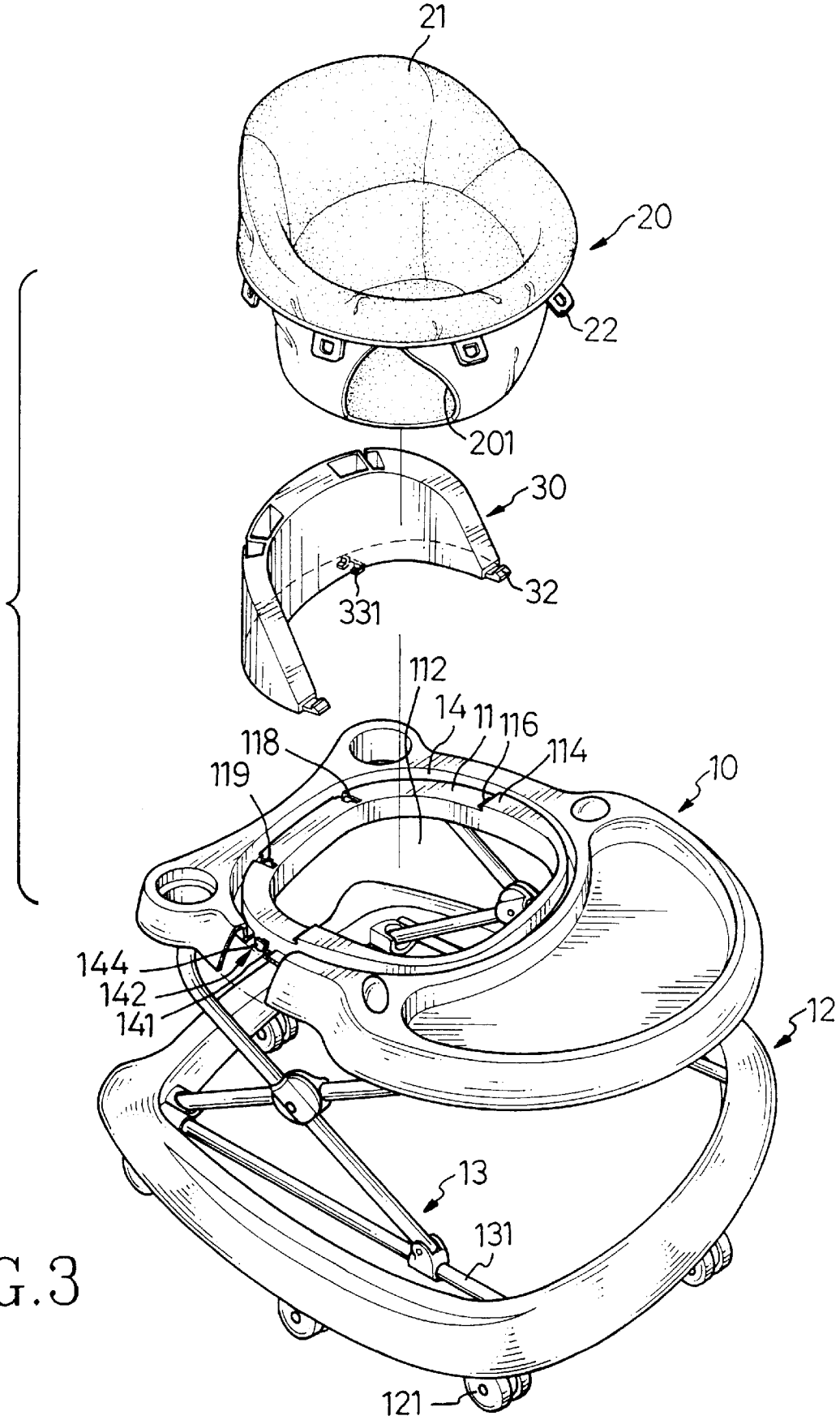
FIG. 3 is an exploded view of a baby walker in accordance with the present invention.

Referring to the drawings and initially to FIG. 3, a baby walker in accordance with the present invention generally includes an upper part 10 having an opening 112 defined therethrough, a lower part 12 being a ring member and having a plurality of wheels 121 rotatably disposed to an underside thereof, and two pairs of crosswise connected links 13 adjustably connected between the upper and lower members 10, 12. Two guide rods 131 are disposed parallelly within the lower part 12 and each of the crosswise connected links 13 has a lower end slidably mounted to the corresponding guide rod 131 so that a distance between the upper and the lower part 10, 12 can be adjusted by operating the two pairs of crosswise connected links 13.

Figure 4:
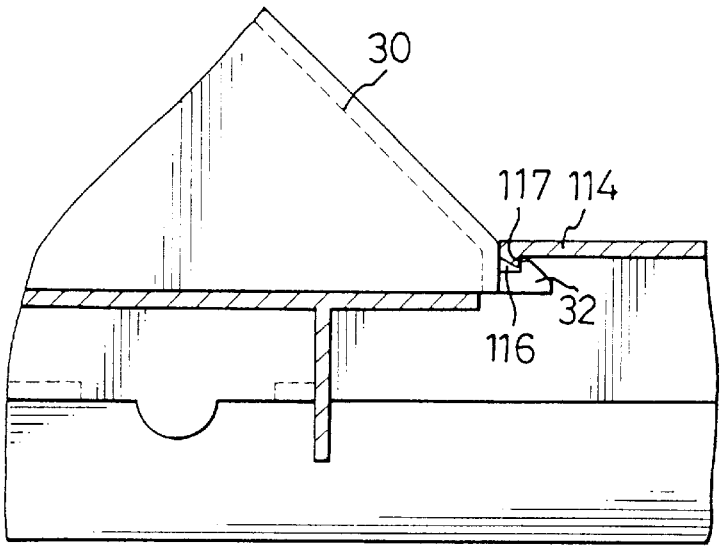
FIG. 4 is a side elevational view, partly in section, of a back member connected to an upper part of the baby walker of the present invention by engaging first and second hooks respectively formed on the back member and the upper part.

The upper part 10 has a groove 14 defined in an upper surface thereof so as to form a collar member 11 which defines the opening 112. The collar member 11 has an arc portion 114 which has a raised upper surface so as to define two apertures 116 between an upper surface of the collar member 11 and the raised upper surface of the arc portion 114. The two apertures 116 are located diametrically opposite to each other on the collar member 11. Referring to FIG. 4, two first hooks 117 are respectively formed in an underside of two distal ends of the raised upper surface, wherein the two distal ends respectively define the two apertures 116. The upper surface of the collar member 11 has two slots 118 defined therein and two recesses 119 are defined in the upper surface of the collar member 11, each communicating with a respective one of the slots 118. The collar member 11 further has a plurality of protrusions 142 extending laterally and outwardly therefrom within the groove 14, wherein each of the protrusions 142 has an enlarged head 144. A bottom defining the groove 14 has a plurality of holes 141 defined therethrough and each of the holes 141 is located corresponding to a respective one of the protrusions 142.

Figure 5:
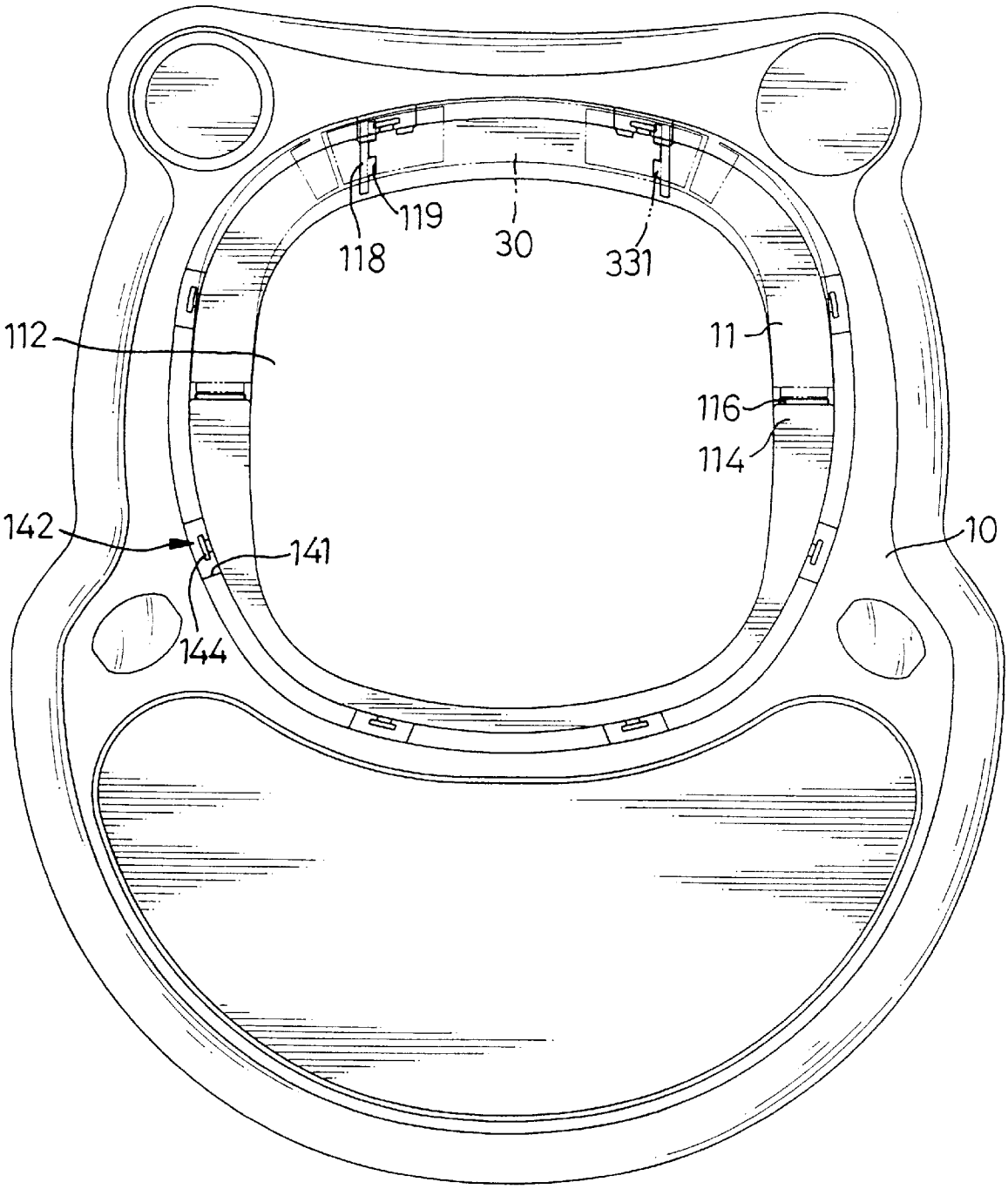
FIG. 5 is a top plan view to show how the back member is connected to the upper part by engaging L-shaped plates on the back member to recesses defined in the upper part.

A back member 30 has two second hooks 32 extending from two lower distal ends thereof and which are sized to be inserted through the two apertures 116 to engage with the two first hooks 117. The back member 30 further has two sets of L-shaped plates 331 extending downwardly from an underside thereof. Referring to FIG. 5, each of the two sets of L-shaped plates 331 is inserted downwardly into the recesses 19 and pushed toward the arc portion 114 to be stopped by an underside of the collar member 11 such that the back member 30 is firmly connected to the upper part 10.

Figure 7:
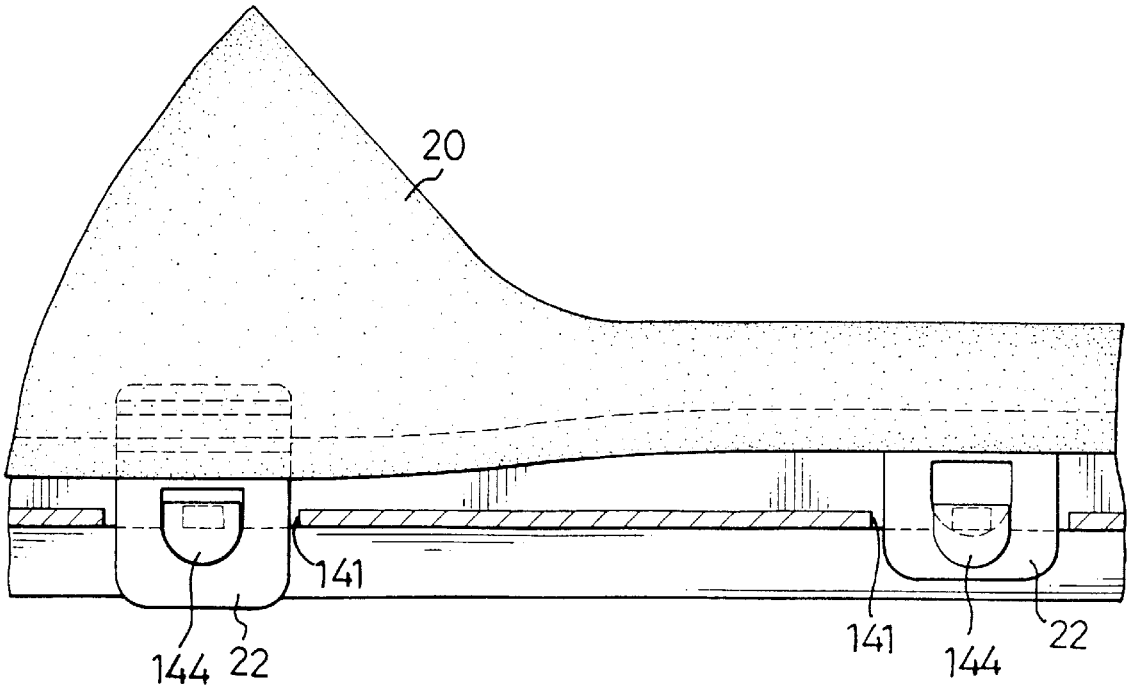
FIG. 7 is a side elevational view to show two ring members on the seat member engaged to two protrusions extending from the upper part of the baby walker of the present invention, wherein the ring member shown on the left side indicates that when the ring member is not yet pulled upwardly and the ring member shown on the right side indicates that when the ring member is pulled upwardly.
Figure 6:
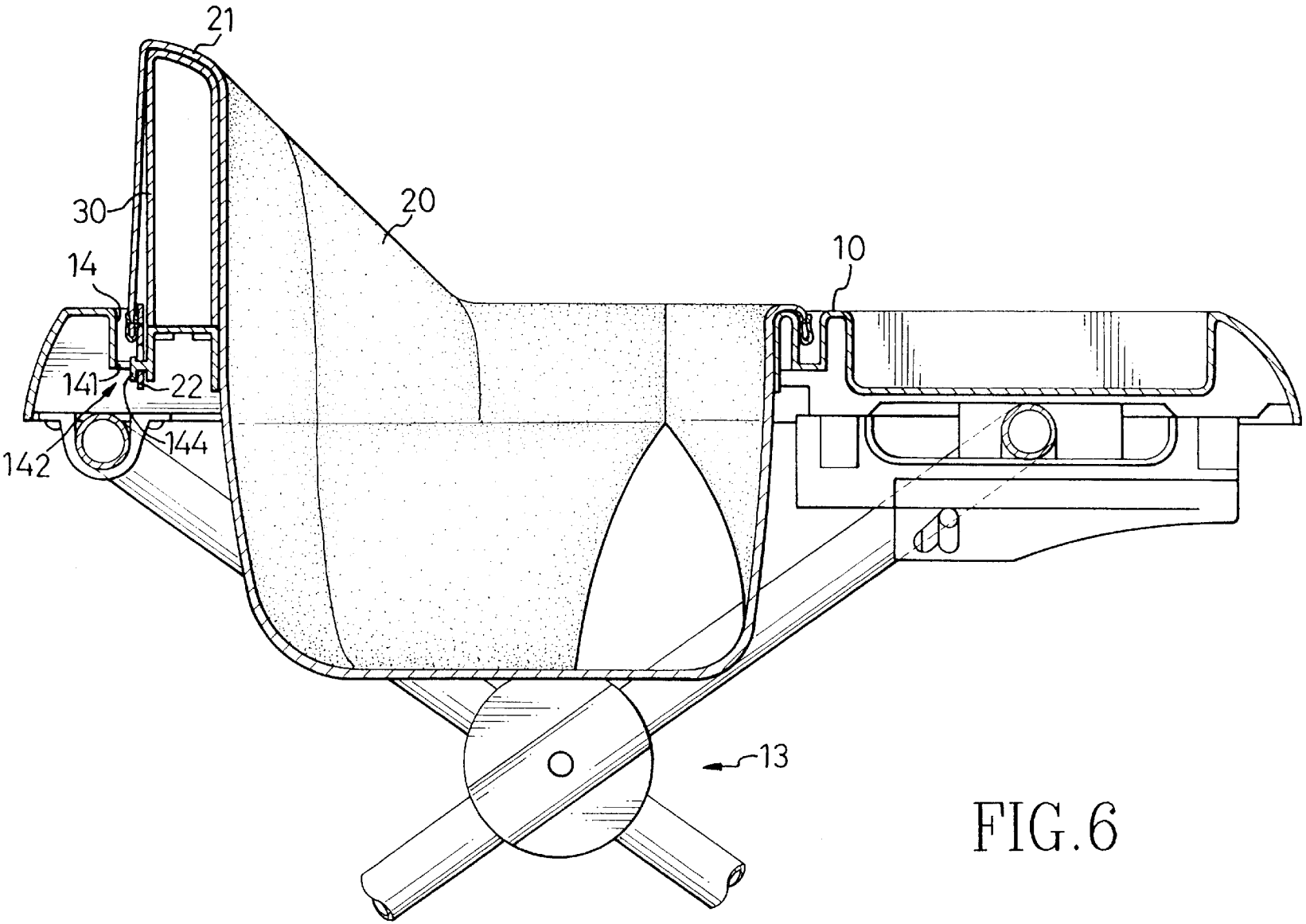
FIG. 6 is a side elevational view, partly in section, of a seat member connected to an upper part of the baby walker of the present invention.

A seat member 20 has two holes 201 defined in a lower portion thereof so as to allow two legs of a baby to be inserted therethrough and an envelope portion 21 extending upwardly therefrom has a lower periphery having a plurality of ring members 22 attached thereto. Referring to FIGS. 6 and 7, the back member 30 is received in the envelope portion 21 and the envelope portion 21 is securely connected to the collar member 11 by securely mounting the ring members 22 to the protrusions 142. When a baby (not shown) is not seated in the seat member 20, the relationship between each of ring members 22 and the protrusions 142 are show as the left side of the FIG. 7. When the baby is seated in the seat member 20, the ring members 22 will be pulled upwardly so as to securely engage with the protrusions 142 as shown in the right side of FIG. 7.

Although the invention has been explained in relation to its preferred embodiment, it is to be understood that many other possible modifications and variations can be made without departing from the spirit and scope of the invention as hereinafter claimed.

What is claimed is:

1. A baby walker comprising:

an upper part having an opening defined therethrough and a groove defined in an upper surface thereof so as to form a collar member which defines said opening, said collar member having an arc portion which has a raised upper surface so as to define two apertures between an upper surface of the collar member and said raised upper surface of said arc portion, said two apertures located diametrically opposite to each other on said collar member, said raised upper surface having two first hooks respectively formed to an underside of two distal ends thereof which respectively define said two apertures;

a lower part being a ring member and having a plurality of wheels rotatably disposed to an underside thereof;

two pairs of crosswise connected links adjustably connected between said upper and lower members;

a back member having two second hooks extending from two lower ends thereof so as to be inserted through said two apertures and engaged with said two first hooks, and a seat member having two holes defined in a lower portion thereof and an envelope portion extending upwardly therefrom which has a lower periphery, said back member being received in said envelope portion and said envelope portion being securely connected to said collar member.

2. The baby walker as claimed in claim 1 wherein said lower periphery of said envelope portion has a plurality of ring members attached thereto and said collar member has a plurality of protrusions extending laterally and outwardly therefrom so that said ring members are securely mounted to said protrusions.

3. The baby walker as claimed in claim 1 wherein said back member has two sets of L-shaped plates extending downwardly from an underside thereof and said upper surface of said collar member has a slot defined therein, two recesses defined in said upper surface of said collar member and communicating with said slot so that each of said two sets of L-shaped plates are inserted into said recesses and pushed toward said arc portion to be stopped by an underside of said collar member.

* * * * *